US005495783A

United States Patent [19]

Slusar et al.

[11] Patent Number: 5,495,783

[45] Date of Patent: Mar. 5, 1996

[54] REVERSIBLE RATCHET WRENCH WITH DIRECTION INDICIA

[75] Inventors: Randall J. Slusar, Greenfield; Jeffrey H. Hoff, Kenosha, both of Wis.

[73] Assignee: Snap-on Incorporated, Kenosha, Wis.

[21] Appl. No.: 271,965

[22] Filed: Jul. 8, 1994

[51] Int. Cl.[6] ..... B25B 13/46

[52] U.S. Cl. ..... 81/63.2; 81/DIG. 5

[58] Field of Search ..... 81/60–63.2, DIG. 5

[56] References Cited

U.S. PATENT DOCUMENTS

| | | | |
|---|---|---|---|
| 588,438 | 8/1897 | Johnson et al. . | |
| 1,748,218 | 9/1928 | Groves . | |
| 1,957,462 | 5/1934 | Kress . | |
| 2,110,099 | 3/1938 | Thewes . | |
| 2,341,375 | 2/1944 | Hambleton . | |
| 2,427,153 | 9/1947 | Mossberg . | |
| 2,578,687 | 12/1951 | Fish . | |
| 2,660,910 | 12/1953 | Sellers . | |
| 3,337,014 | 8/1967 | Sandrick . | |
| 4,080,851 | 3/1978 | Rogers . | |
| 4,497,227 | 2/1985 | Stasiek | 87/63.2 X |
| 4,762,033 | 8/1988 | Chow | 87/63.2 |
| 5,180,175 | 1/1993 | Doolittle . | |

OTHER PUBLICATIONS

Snap–on Incorporated Catalog p. 61.

*Primary Examiner*—James G. Smith
*Attorney, Agent, or Firm*—Emrich & Dithmar

[57] ABSTRACT

A reversible ratchet wrench has a wrench handle with a circular ratchet head having a cylindrical array of ratchet teeth and receiving coaxially rotatably therein a drive body. A pawl is carried by the drive body for movement between forward and reverse conditions of engagement with the ratchet teeth, being retained in each of these positions by an over-center spring engageable with a pin on a reversing lever disposed coaxially with the drive body and retained thereon by a bushing and a screw for rotation relative to the drive body and the ratchet head for shifting the pawl between its forward and reverse conditions. Indicia on the bushing and the reversing lever cooperate to indicate the condition of the pawl.

20 Claims, 1 Drawing Sheet

REVERSIBLE RATCHET WRENCH WITH DIRECTION INDICIA

BACKGROUND OF THE INVENTION

1. Field of the Invention

The present invention relates to ratchet mechanisms and, in particular, ratchet wrenches of the reversible type having a manually-operated reversing lever. The invention relates in particular to indicia for indicating the operational conditions selected by the reversing mechanism.

2. Description of the Prior Art

Reversible ratchet mechanisms, for use in ratchet wrenches and the like, are well known in the art. Such ratchet mechanisms commonly have a reversing lever which is manually operable for shifting a pawl mechanism between forward and reverse operating conditions. In one such reversible ratchet, made by Snap-on Incorporated, the ratchet head is oblong or oval-shaped and the reversing lever pivots about an axis which is offset from the axis of rotation of the ratchet drive body. In another Snap-on reversible ratchet, known as a "round head" ratchet, the reversing lever is in the form of a ribbed disk which is coaxial with the ratchet drive body.

A common problem with such prior reversible round head ratchet mechanisms is that it was not easy for the operator to know in which condition the mechanism was set. In order to determine this, an operator first had to test the ratchet to see which direction it was set for and, if it was not the desired direction, he would actuate the reversing lever to the opposite condition. Also, in such prior reversible ratchet mechanisms the operator could not tell, without first testing the mechanism, whether or not it was fully engaged in either of the forward or reverse conditions or, alternatively, was disposed in an intermediate or neutral condition wherein the pawl mechanism was not engaged in either direction.

Prior devices have attempted to solve this problem by providing indicia on the mechanism so that an operator could tell whether or not the pawl mechanism was disposed in a fully engaged condition and, if so, to indicate whether it was in the forward or reverse condition. But such prior indicating arrangements have involved the use of indicia on the ratchet head or handle portion and, therefore, their proper use has been contingent upon assembly of the ratchet mechanism in the head in the proper initial orientation relative to the ratchet head. Also, because the indicia are on the head or handle portion, that head cannot be used with other, non-reversible ratchet assemblies.

SUMMARY OF THE INVENTION

It is a general object of the invention to provide an improved reversible ratchet mechanism which avoids the disadvantages of prior mechanisms while affording additional structural and operating advantages.

An important feature of the invention is the provision of a reversible ratchet mechanism of the type set forth, which affords clear and unambiguous indications of the direction of operation of the device.

In connection with the foregoing feature, a further feature of the invention is the provision of a ratchet mechanism of the type set forth which is of simple and economical construction.

A still further feature of the invention is the provision of a ratchet wrench incorporating the ratchet mechanism of the type set forth, and in which there are no indicia on the wrench handle or head.

These and other features of the invention are attained by providing a reversible ratchet mechanism comprising: first and second bodies rotatable about a common axis, the first body having a cylindrical array of ratchet teeth, a pawl mechanism carried by the second body for movement between forward and reverse conditions of engagement with the ratchet teeth, the pawl mechanism in its forward condition accommodating relative rotational movement of the bodies in only a first manner, the pawl mechanism in its reverse condition accommodating relative rotational movement of the bodies in only a second manner opposite to the first manner, a reversing lever coupled to the pawl mechanism and manually movable relative to the bodies for effecting movement of the pawl mechanism between the forward and reverse conditions thereof, and indicia on the lever and the second body for cooperation to indicate the condition of the pawl mechanism.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
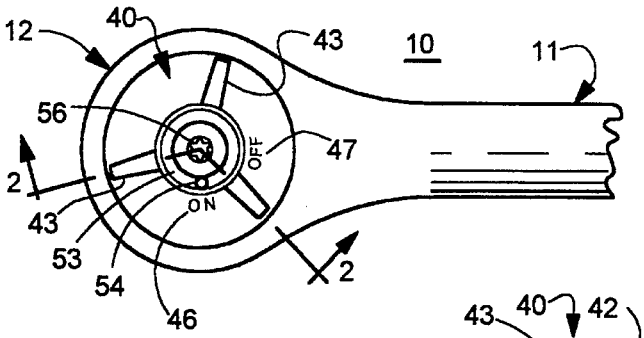
FIG. 1 is a fragmentary top plan view of a reversible ratchet wrench constructed in accordance with and embodying the features of the present invention.

Referring to FIGS. 1–4, there is illustrated a reversible ratchet wrench generally designated by the numeral 10, constructed in accordance with and embodying the features of the present invention. The ratchet wrench 10 has an elongated handle 11 having formed unitary therewith at one end thereof a circular ratchet head 12. The head 12 has an enlarged circular bore 13 formed axially therethrough. Formed on the inner surface of the bore 13 is a cylindrical array of equiangularly spaced-apart ratchet teeth 15. The bore 13 extends between opposite side surfaces of the head 12, said side surfaces having respectively formed therein annular recesses 16 and 17, in which are respectively seated annular seals 18 and 19.

Disposed coaxially in the bore 13 for rotation about the axis thereof relative to the head 12 is a drive body 20, having a square drive lug 21 unitary therewith at one end thereof and projecting axially therefrom for engagement with an associated driven member, such as a socket, all in a known manner. The drive lug 21 may be provided with a depressible detent ball (not shown), also in a known manner. The drive body 20 is provided with a radially outwardly extending annular flange 22 dimensioned to be received in the annular recess 16 at one side of the head 12. The flange 22 has an annular recess 23 formed in the inner surface thereof dimensioned for accommodating the associated seal 18.

Figure 2:
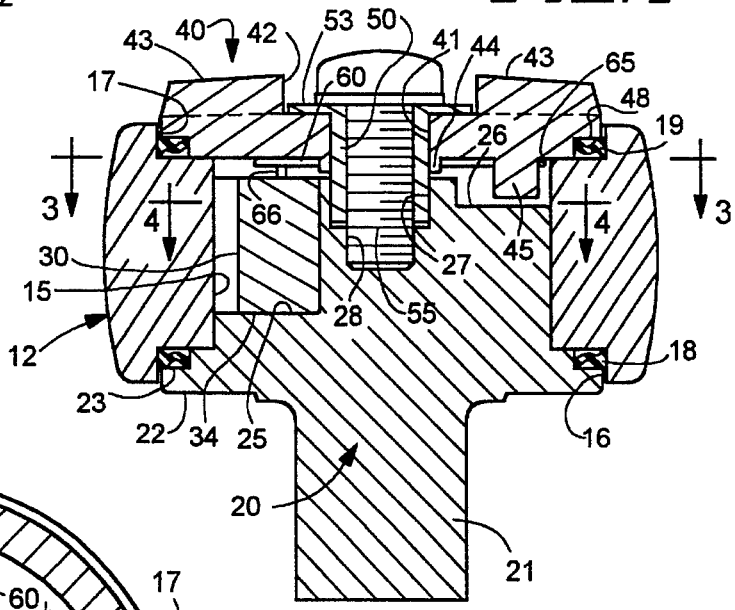
FIG. 2 is an enlarged view in vertical section taken along the line 2—2 in FIG. 1.

The drive body 20 has an end surface 24 formed at the other axial end thereof opposite the drive lug 21, the drive body 20 being dimensioned so that the end surface 24 is disposed axially inwardly of the annular recess 17 when the annular flange 22 is seated in the annular recess 16, as illustrated in FIG. 2. The end surface 24 has a deep pawl recess 25 formed therein at one side thereof, the pawl recess 25 having an axial wall which defines a chord of the drive body 20. Formed in the end surface 24 at the opposite side thereof is a shallower pin recess 26, which also has an axial wall defining a chord of the drive body 20 substantially parallel to that of the pawl recess 25. Also formed in the end surface 24 intermediate the pawl recess 25 and the pin recess 26 is a substantially rectangular recess 27, which has a depth greater than that of the pin recess 26 but less than that of the pawl recess 25. The rectangular recess 27 has a length substantially perpendicular to the axial walls of the pawl and pin recesses 25 and 26 and a width substantially parallel to those walls. Formed centrally of the rectangular recess 27 and coaxially with the drive body 20 is an internally threaded cylindrical bore 28.

Seated in the pawl recess 25 is a pawl 30. Formed on the outer side of the pawl 30 is an arcuate array of teeth 31 facing and dimensioned for meshing engagement with the ratchet teeth 15 of the head 12. The array of teeth 31 has a radius less than that of the cylindrical array of ratchet teeth 15, so that only a few of the pawl teeth 31 can engage the ratchet teeth 15 at any one time. Formed on the opposite side of the pawl 30 is a flat rear surface 32 dimensioned for sliding engagement with the axial wall of the pawl recess 25. The tooth array 31 and the rear surface 32 extend between flat, parallel, top and bottom surfaces 33 and 34 of the pawl 30. The pawl 30 is also provided, respectively, at the opposite ends of the rear surface 32, with beveled surfaces 35 and 36 which are inclined at a predetermined angle to the rear surface 32. Formed axially through the pawl 30 midway between its opposite ends is a cylindrical bore 37 extending between the top and bottom surfaces 33 and 34 (FIG. 3), and having a part frustoconical counterbore 38 at the top surface 33.

The ratchet wrench 10 is also provided with a reversing lever 40, generally in the shape of a circular disk having an axial bore 41 formed therethrough and surrounded at the upper end thereof with an annular recess 42. Formed on the outer surface of the reversing lever 40 are three equiangularly spaced apart and radially extending ribs 43. Depending from the inner surface of the reversing lever 40 is an annular hub 44 disposed in surrounding relationship with the bore 41. Also depending from the inner surface of the reversing lever 40 and spaced a predetermined distance radially outwardly from the bore 41 is a cylindrical pin 45, which is preferably unitary with the lever 40. Formed on the outer surface of the reversing lever 40, radially just outside the recess 42 and at angularly spaced-apart locations, are ON and OFF indicia 46 and 47. The reversing lever 40 is dimensioned to be seated in the recess 17 of the head 12, the reversing lever 40 having an annular recess 48 in the inner surface thereof at the outer edge thereof dimensioned for accommodating the seal 19. The reversing lever 40 is positioned on the head 12 so that the pin 45 is received in the pin recess 26, the bore 41 being coaxial with the drive body 20.

The ratchet wrench 10 also includes a cylindrical bushing 50 dimensioned to be received through the bore 41 of the reversing lever 40 and into the rectangular recess 27 of the drive body 20. In this regard, the bushing 50 has an outer diameter substantially equal to or very slightly less than the length of the rectangular recess 27 and has formed on diametrically opposite sides thereof adjacent to the distal end thereof flats 51 and 52 spaced apart a distance very slightly less than the width of the rectangular recess 27. Thus, it will be appreciated that the distal end of the bushing 50 is keyed or non-rotatably received in the rectangular recess 27. The bushing 50 is provided adjacent to its outer end with a radially outwardly extending annular flange 53 which is seated in the recess 42 of the reversing lever 40 when the distal end of the bushing 50 is keyed into the rectangular recess 27. The flange 53 has formed on the outer surface thereof an indicator indicium 54 (FIG. 1). A screw 55 is receivable through the bushing 50 for threaded engagement in the threaded bore 28, the screw 55 having an enlarged head 56 which seats against the annular flange 53. Thus, it will be appreciated that the screw 55 cooperates with the bushing 50 to hold the parts of the ratchet wrench 10 in an assembled condition, retaining the drive body 20 in the annular recess 16 and retaining the reversing lever 40 in the annular recess 17 of the ratchet head 12.

The ratchet wrench 10 also includes a bias spring 60 in the form of an elongated wire spring member having a generally heart-shaped configuration, including a pair of opposed lobes 62 and 63 and an apex 65, all lying in a plane substantially perpendicular to the axis of the drive body 20 between the reversing lever 40 and the drive body 20. Unitary with the lobes 62 and 63, at the ends thereof opposite the apex 65, are anchor ends 66 (one shown in FIG. 2) which extend axially into the frustoconical counterbore 38 of the pawl bore 37. As can best be seen in FIG. 3, the spring 60 encircles the bushing 50 and the reversing lever pin 45, with the pin 45 being disposed within the apex 65 of the spring 60.

The spring 60 operates as an over-center spring. Thus, when the reversing lever 40 is rotated to the ON position, illustrated in FIGS. 1 and 3, this movement being limited by engagement of the pin 45 with the axial surface of the pin recess 26, the pin 45 moves the spring 60 to the position illustrated in FIG. 3, wherein the lobe 63 is against the outer surface of the hub 44 and the pawl 30 is pulled toward one side of the pawl recess 25 so that the end of the pawl 30 adjacent to the bevel 35 is disposed in meshing engagement with the ratchet teeth 15 in a forward or ON condition of engagement. Conversely, when the reversing lever 40 is rotated to the OFF position, the pin 45 pulls the spring 60 to an opposite condition (not shown), wherein the lobe 62 is disposed against the hub 44, thereby pulling the pawl 30 downwardly along the pawl recess 25, as viewed in FIG. 3, so that the end thereof adjacent to the bevel 36 is disposed in meshing engagement with the ratchet teeth 15 in a reverse or OFF condition.

It is a significant aspect of the invention that, when the parts are in their assembled condition, the reversing lever 40 is manually rotatable, by engagement of the user's fingers with the ribs 43, between the ON and OFF positions, relative to both the head 12 and the bushing 50. Thus, since the bushing 50 is keyed to the drive body 20, it also does not move as the reversing lever 40 is rotated. When the reversing lever 40 is in the ON position, the ON indicium will be radially aligned with the bushing indicator indicium 54, as illustrated in FIG. 1 and, when the reversing lever 40 is rotated to its OFF position, the OFF indicium will be disposed radially aligned with the bushing indicator indicium 54. Thus, the condition of operation of the ratchet wrench 10 will be readily apparent to a user. Furthermore, it will be clear if the ratchet mechanism is disposed in some intermediate position, since in that case the bushing indicator indicium 54 will be disposed between the ON and OFF indicia and radially aligned with neither.

Figure 3:
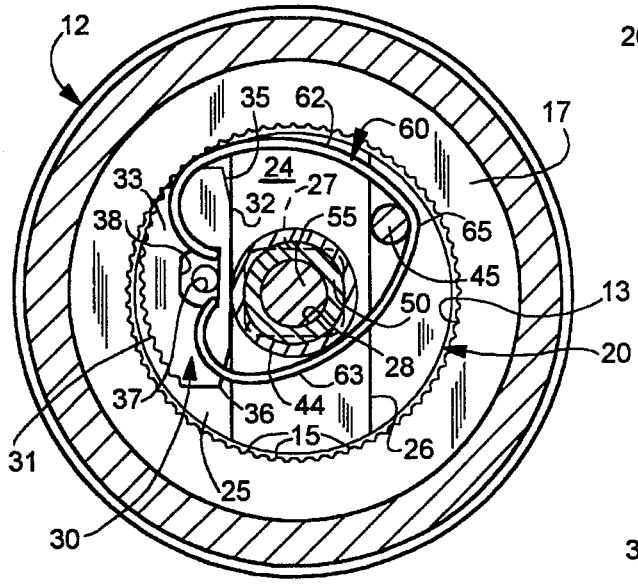
FIG. 3 is a view in horizontal section taken along the line 3—3 in FIG. 2.
Figure 4:
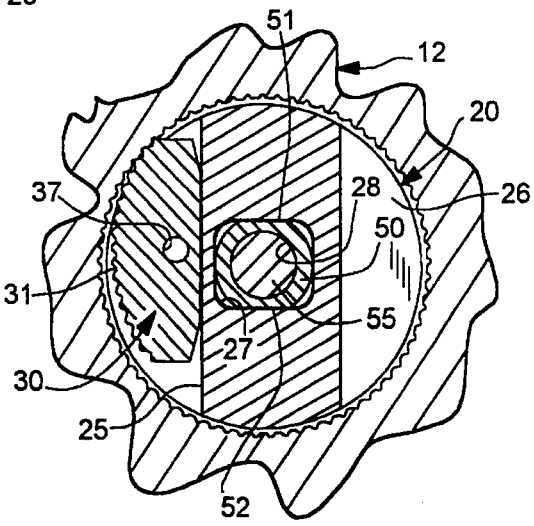
FIG. 4 is a fragmentary view in horizontal section taken along the line 4—4 in FIG. 2.

When the pawl 30 is in the forward or ON condition, illustrated in FIG. 3, if the drive lug 21 is engaged with a driver member, rotation of the head 12 in a clockwise direction, as viewed in FIG. 3, will tend to wedge the pawl 30 into firmer meshing engagement with the ratchet teeth 15, so that the pawl 30 and the drive body 20 will rotate with the head 12, so that a driving force exerted on the handle 11 can be transmitted to the drive body 20 and thence to the driven member. When the head 12 is rotated in the opposite or counterclockwise direction, as viewed in FIG. 3, this movement will tend to slide the pawl 30 downwardly along the pawl recess 25, allowing the head 12 to ratchet past the pawl 30, this ratcheting movement being accommodated by the spring 60 which tends to resiliently urge the pawl 30 back into engagement with the ratchet teeth 15, all in a known manner. This forward mode of operation is designated by the ON indicium, since this clockwise rotation of the head 12 will normally be used to tighten an associated fastener or put it "ON".

It will similarly be appreciated that, when the reversing lever 40 is rotated to its OFF position, shifting the pawl 30 to its OFF condition of engagement, a counterclockwise rotation of the head 12 will be transmitted to the drive body 20 and the driven member while, when the head 12 is rotated in a clockwise direction, it will ratchet past the pawl 30. This mode of operation is designated OFF, since a counterclockwise rotation of the head 12 is normally used to loosen an associated fastener or take it "OFF".

It will be appreciated that the spring 60 serves to resiliently hold the reversing lever 40 in each of its selected ON and OFF positions, thereby resiliently resisting accidental movement of the reversing lever from either of these selected positions. Preferably, the screw 55 is so dimensioned that it will bottom in the threaded bore 28 before it applies a significant clamping force against the bushing flange 53, so that the reversing lever 40 will remain freely rotatable relative to the bushing 50 and to the ratchet head 12.

From the foregoing, it can be seen that there has been provided an improved reversible ratchet wrench which is of simple and economical construction and which provides positive and unambiguous indication to the user of the condition of operation of the tool.

We claim:

1. A reversible ratchet mechanism comprising: first and second bodies rotatable about a common axis, said first body having a cylindrical array of ratchet teeth, a pawl mechanism carried by said second body for movement between forward and reverse conditions of engagement with said ratchet teeth, said pawl mechanism in its forward condition accommodating relative rotational movement of said bodies in only a first manner, said pawl mechanism in its reverse condition accommodating relative rotational movement of said bodies in only a second manner opposite to said first manner, a reversing lever coupled to said pawl mechanism and manually movable relative to said bodies for effecting movement of said pawl mechanism between the forward and reverse conditions thereof, said lever and said second body respectively having first and second external surfaces, and indicia disposed on said first and second surfaces so as to be at all times exposed in their entirety to view by a user for cooperation to indicate the condition of said pawl mechanism.

2. The ratchet mechanism of claim 1, and further comprising an over-center bias spring coupled to said pawl mechanism and resiliently resisting movement of said pawl mechanism from either of its forward and reverse conditions.

3. The ratchet mechanism of claim 2, wherein said reversing lever includes a pin engageable with said bias spring.

4. The ratchet mechanism of claim 3, wherein said spring includes a generally heart-shaped wire disposed in a plane substantially perpendicular to said axis and having an apex, said pin being disposed within said spring and in engagement therewith adjacent to said apex.

5. The ratchet mechanism of claim 1, wherein said pawl mechanism includes an elongated pawl member having opposite ends respectively engageable with said ratchet teeth in the forward and reverse conditions of said pawl mechanism.

6. The ratchet mechanism of claim 1, wherein said indicia include an indicator indicium on said second body and circumferentially spaced-apart ON and OFF indicia on said reversing lever.

7. A reversible ratchet mechanism comprising: first and second bodies rotatable about a common axis, said first body having a cylindrical array of ratchet teeth, a pawl mechanism carried by said second body for movement between forward and reverse conditions of engagement with said ratchet teeth, said pawl mechanism in its forward condition accommodating relative rotational movement of said bodies in only a first manner, said pawl mechanism in its reverse condition accommodating relative rotational movement of said bodies in only a second manner opposite to said first manner, a reversing lever having an opening therein and coupled to said pawl mechanism and manually movable relative to said bodies for effecting movement of said pawl mechanism between the forward and reverse conditions thereof, a bushing extending through said opening in said reversing lever and coupled to said second body for rotation therewith and cooperating with said first body for retaining said reversing lever thereon, first indicia on said bushing, second indicia on said reversing lever disposed for cooperation with said first indicia to indicate the condition of said pawl mechanism, and a fastener connecting said bushing to said second body.

8. The ratchet mechanism of claim 7, wherein said bushing is disposed coaxially with said bodies.

9. The ratchet mechanism of claim 8, wherein said second body has a non-circular recess formed therein, said bushing being dimensioned to be mateably and non-rotatably received in said recess.

10. The ratchet mechanism of claim 8, wherein said bushing includes a retaining flange overlying said reversing lever.

11. The ratchet mechanism of claim 7, wherein said fastener is a screw received coaxially through said bushing and threadedly engaged with said second body.

12. A ratchet wrench comprising: a wrench handle having a ratchet head at one end thereof provided with a cylindrical array of ratchet teeth, a drive body carried by said ratchet head for rotation therewith and relative thereto about a common axis, a pawl mechanism carried by said drive body for movement between forward and reverse conditions of engagement with said ratchet teeth, said pawl mechanism in its forward condition accommodating relative rotational movement of said ratchet head and said drive body in only a first manner, said pawl mechanism in its reverse condition accommodating relative rotational movement of said ratchet head and said drive body in only a second manner opposite to said first manner, a reversing lever coupled to said pawl mechanism and manually movable relative to said drive body and to said ratchet head for effecting movement of said pawl mechanism between the forward and reverse conditions thereof, said lever and said second body respectively having first and second external surfaces, and indicia disposed on said first and second surfaces so as to be at all times exposed in their entirety to view by a user for cooperation to indicate the condition of said pawl mechanism.

13. The ratchet wrench of claim 12, and further comprising an over-center bias spring coupled to said pawl mechanism and resiliently resisting movement of said pawl mechanism from either of its forward and reverse conditions.

14. The ratchet wrench of claim 12, wherein said pawl mechanism includes an elongated pawl member having opposite ends respectively engageable with said ratchet teeth in the forward and reverse conditions of said pawl mechanism.

15. The ratchet wrench of claim 12, and further comprising a bushing coupled to said drive body for rotation therewith and cooperating with said ratchet head for retaining said reversing lever thereon.

16. The ratchet wrench of claim 15, wherein said bushing is disposed coaxially with said drive body and said ratchet head, said drive body having a non-circular recess formed therein, said bushing being matingly and non-rotatably received in said recess.

17. The ratchet wrench of claim 16, wherein said bushing includes a retaining flange overlying said reversing lever.

18. The ratchet wrench of claim 17, and further comprising a screw received through said bushing and threadedly engaged with said drive body.

19. The ratchet wrench of claim 18, wherein said ratchet head has opposed ends with annular recesses respectively formed therein, said drive body having a mounting flange received in one of said recesses and said lever having an annular flange being received in the other of said recesses, whereby said screw holds together said drive body and said ratchet head and said reversing lever and said bushing.

20. The ratchet wrench of claim 12, wherein said indicia on said lever include an "ON" indicium and an "OFF" indicium.

* * * * *